US005129300A

United States Patent [19]

Kawakami

[11] Patent Number: 5,129,300

[45] Date of Patent: Jul. 14, 1992

[54] DESK-TOP TYPE CUTTER

[75] Inventor: Hideki Kawakami, Mitsugi, Japan

[73] Assignee: Ryobi Limited, Hiroshima, Japan

[21] Appl. No.: 713,856

[22] Filed: Jun. 12, 1991

[30] Foreign Application Priority Data

Jun. 21, 1990 [JP] Japan ..... 2-65614[U]

[51] Int. Cl.[5] ..... B26D 7/22; B27G 19/02

[52] U.S. Cl. ..... 83/471.2; 83/478; 83/490; 30/391

[58] Field of Search ..... 83/397, 471.2, 478, 83/490, 546; 30/388, 390, 391

[56] References Cited

U.S. PATENT DOCUMENTS

| | | | |
|---|---|---|---|
| 1,900,553 | 3/1933 | Hampton | 83/397 X |
| 2,801,654 | 8/1957 | Utz | 30/391 |
| 3,626,783 | 12/1971 | Jägers | 83/490 |
| 3,812,584 | 5/1974 | Peter | 30/391 X |
| 4,693,008 | 9/1987 | Velie | 30/390 |

FOREIGN PATENT DOCUMENTS

| | | | |
|---|---|---|---|
| 39095 | 7/1915 | Sweden | 83/478 |
| 46517 | 2/1920 | Sweden | 83/478 |

*Primary Examiner*—Frank T. Yost
*Assistant Examiner*—Raymond D. Woods
*Attorney, Agent, or Firm*—Oliff & Berridge

[57] ABSTRACT

A desk-tip type cutter fixed to a table comprises a cutter body pivotably supported on the table, a circular saw blade arranged to be rotatable about its axis, a safety cover for covering the circular saw blade and a safety cover operating mechanism for pivotally opening and closing the safety cover. The safety cover driving mechanism includes a gear having at least one tooth and a lever having at least one engaging member to engage with the gear. A spring member is disposed between the cutter body and the lever for biasing the lever in a direction separating the engaging member from the gear.

7 Claims, 5 Drawing Sheets

DESK-TOP TYPE CUTTER

BACKGROUND OF THE INVENTION

The present invention relates to a desk-top type cutter, and more particularly to an operating mechanism for rotating a safety cover which covers a circular saw blade.

In general, a desk-top type cutter for cutting a wood piece or lumber using a circular saw is well known. In such a desk-top type cutter, the circular saw is covered by a safety cover. Japanese Utility Model Examined Publication No. 62-5289 shows such a desk-top type cutter provided with a safety cover.

FIG. 5 is a side elevational view showing a desk-top type cutter disclosed in that publication. In FIG. 5, a reference numeral 101 denotes a table on which a support member 102 is mounted. A main body 103 of the cutter is pivotably mounted relative to the support member 102 through a support shaft 104 on the support member 102. Further, a safety cover 105 is rotatably mounted on the body 103, and a circular saw blade 106 is rotatably mounted so as to be covered by the safety cover 105. Also, a handle 107 is projected from a suitable portion of the body 103.

On the other hand, an operation lever 108 is pivotably mounted on the handle 107, and one end of a link piece 109 is held in abutment with a left (as viewed) end portion of the operational lever 108 in FIG. 5. One end of a wire 110 is connected to the other end of the link piece 109, and the other end of the wire 110 is in turn connected to a stud 112 of the safety cover 105 after passing through a guide portion 111 provided in the safety cover 105. A spring 114 is interposed between the stud 112 of the safety cover 105 and a stud 113 provided on the body 103, thereby normally biasing the safety cover 105 in a direction indicated by character a.

In such a desk-top type cutter, when it is desired to rotate the safety cover 105 against the biasing force of the spring 114 in the direction indicated by b in FIG. 5, first the operation lever 108 is rotated in the direction indicated by character c. Then, the link piece 109 is depressed in the direction d, so that the end portion, connected to the wire 110, of the link piece 109 is moved in the direction e against the biasing force of the spring 114. Thus, the safety cover 105 is opened by rotation in the direction of b. Under this condition, it is possible to cut the lumber or the like by the circular saw 106.

However, if the link mechanism is used in the safety cover for covering the circular saw, the number of the mechanical parts increases, making it difficult to assemble or fabricate the cutter. Also, since the wire is used in the force transmission mechanism, the force on the lever 108 is not effectively transmitted. Furthermore, since the spring member draws the safety cover and the force transmission mechanism, it is necessary to use a strong spring therefor, resulting in increased costs.

Furthermore, the prior art also discloses a portable hand tool provided with a latching mechanism for releasably latching or locking mechanism for releasably latching or locking a guard member for a rotary saw blade, such as disclosed in U.S. Pat. No. 4,693,008.

The portable circular power saw of this prior art reference has a releasable latching device including a pivotable latch member for releasably latching a guard member for a rotary saw blade in a guarding position. The latch member includes a hook engageable with a retaining notch of the guard member. The latch member is retained in a latching position by a spring-biased push rod and is moved to an unlatching position by operating the push rod. A permanent magnet mounted to the latch member cooperates with a ferromagnetic strip of the guard member to temporarily retain the latch member in its unlatched position as the guard member is rotated to an unguarding position. Thereafter, the permanent magnet and the ferromagnetic strip disengage from each other such that the latch member will automatically be returned to its latching position when the guard member is returned to its guarding position.

The hook of the latch member is engageable with a notch of the guard member for preventing rotation of, but not for transferring rotating force to, the guard member, i.e., the safety cover of the circular saw.

As described, the releasable latching device of this prior art reference comprises many members or parts such as a latch member, a push rod, a spring, a permanent magnet etc., which complicates the structure of the latching device, which is troublesome to assemble and involves high manufacturing cost.

SUMMARY OF THE INVENTION

In order to overcome the above-noted defects, an object of the invention is to provide a desk-top cutter in which a safety cover opening/closing mechanism is readily assembled or fabricated and force transmission is ensured. It is also an object of the invention to reduce the manufacture cost.

These and other objects can be achieved according to the present invention by providing a desk-top cutter fixed on a table comprising a cutter body pivotably supported by a support member which is fixed to the table, a circular saw having a shaft which rotates the circular saw blade, a safety cover pivotally supported about the shaft of the circular saw so as to cover the circular saw blade, a safety cover operating mechanism for opening and closing the safety cover including a gear member having at least one tooth and concentrically mounted to the safety cover and a lever member having at least one engaging member to be engaged with the gear member, and a spring member for biasing the lever member in a direction separating the engaging member from the gear member.

Upon aligning a cut line of the lumber or the like and the circular saw blade, the lever is operated, and the engagement portion provided at one end portion of the lever is engaged with the gear against the biasing force of the spring member. Furthermore, the lever is pivoted about a pin, thereby rotating the gear and also rotating the safety cover fixed to the gear. Under this condition, the cutter is lowered, and the cut line of the lumber is aligned with the position of the circular saw blade. Then, the lever is returned by the biasing force of the spring member back to the position where the lever engagement portion is out of the engagement with the gear. As a result, the safety cover is rotated to a position where the circular saw blade is covered by the safety cover. In this manner, the cutting operation is conducted.

DESCRIPTION OF THE PREFERRED EMBODIMENTS

One embodiment of the present invention will now be described with reference to the accompanying drawings.

Figure 1:
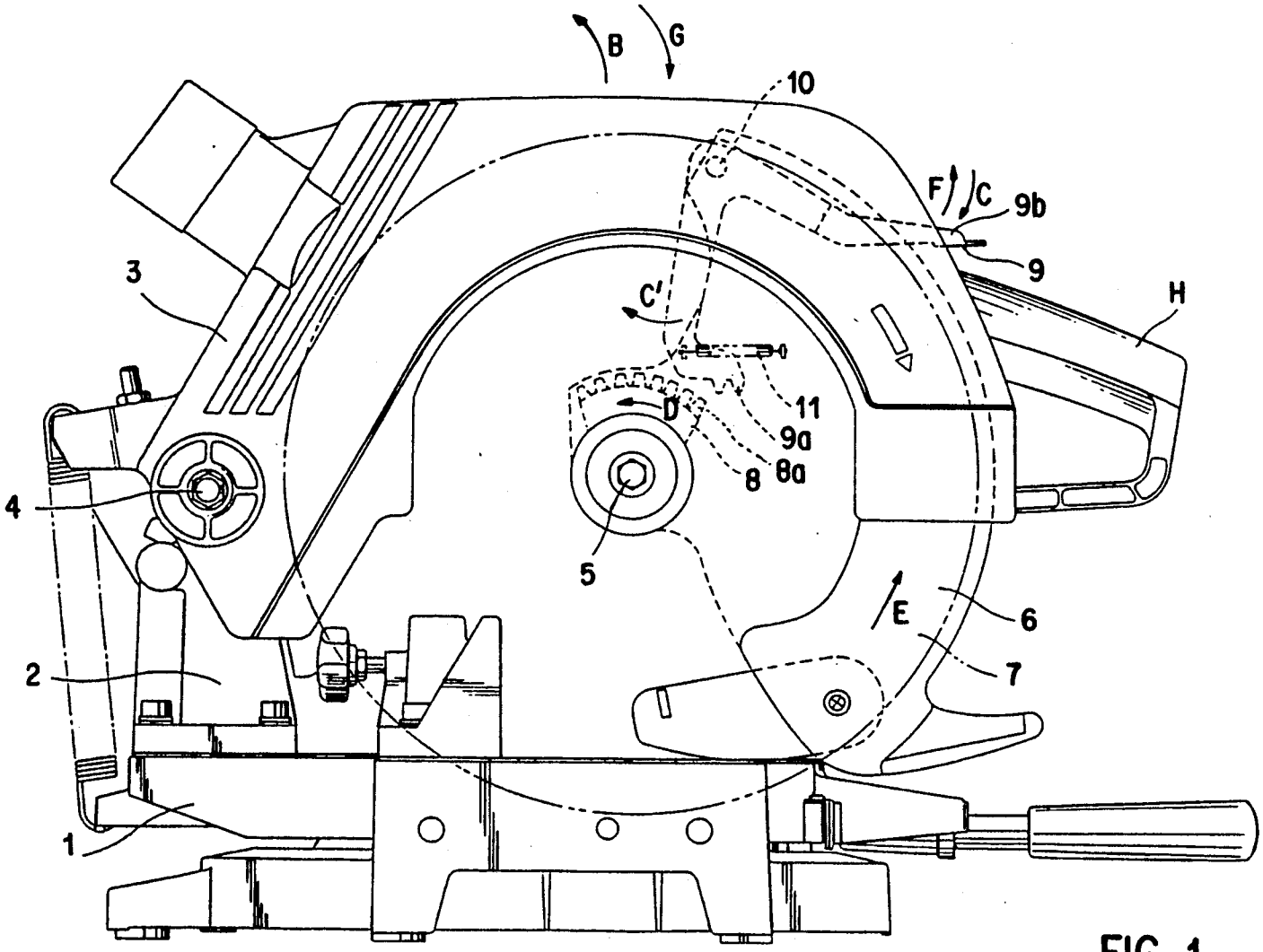
FIG. 1 is a front view showing a desk-top cutter according to the invention.

FIG. 1 is a front view showing a desk-top type cutter according to the present invention. A support member 2 is mounted on a top surface of a table 1. A body 3 is pivotably mounted relative to the support member 2 through a support shaft 4 on the support member 2. Furthermore, a safety cover 6 is rotatably mounted to the body 3 on a shaft 5. A circular saw blade 7 is fixedly mounted on the shaft 5 so as to be covered by the safety cover 6.

Figure 2:
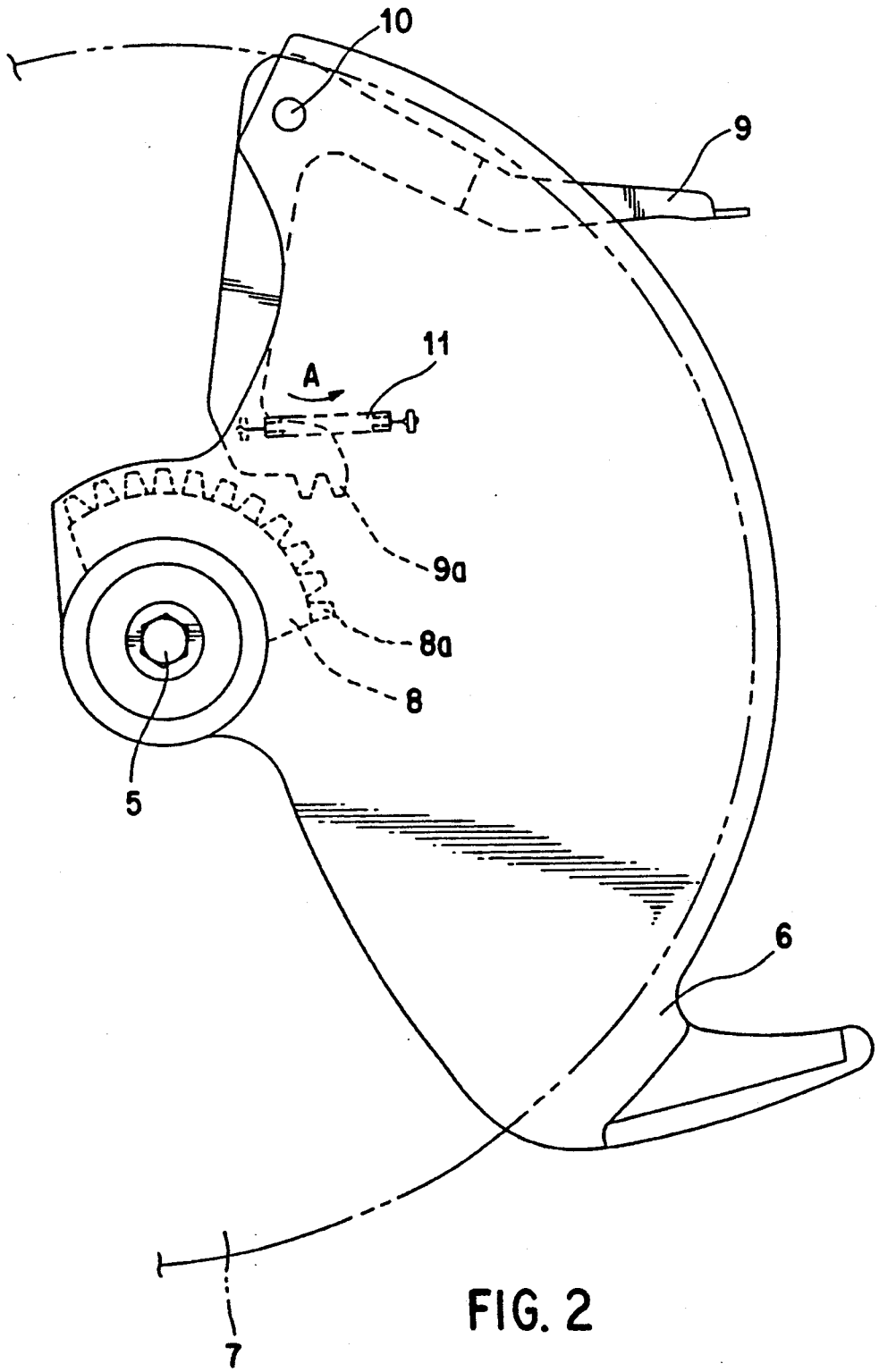
FIG. 2 is a front view showing a drive mechanism of the safety cover of the desk-top type cutter shown in FIG. 1.

A rotational drive mechanism for the safety cover 6 will be explained with reference to FIG. 2. A gear 8 is concentrically fixed to the safety cover 6. On the other hand, a lever 9 having an L-shape is pivotably mounted on a pin 10 at a suitable portion of the body 3. An engagement portion 9*a* which is engageable with the gear 8 is formed at one end of the lever 9. A spring 11 for biasing the lever 9 in the direction A in FIG. 2 is interposed between the engagement portion 9*a* of the lever 9 and the body 3. A pressure portion 9*b* which is the other end portion of the lever 9 is located outside the body 3 in the vicinity of a handle H provided on the body 3. The gear 8 is provided with a plurality of teeth having equal pitch arranged on an outer periphery 8*a* of the gear 8.

Figure 3:
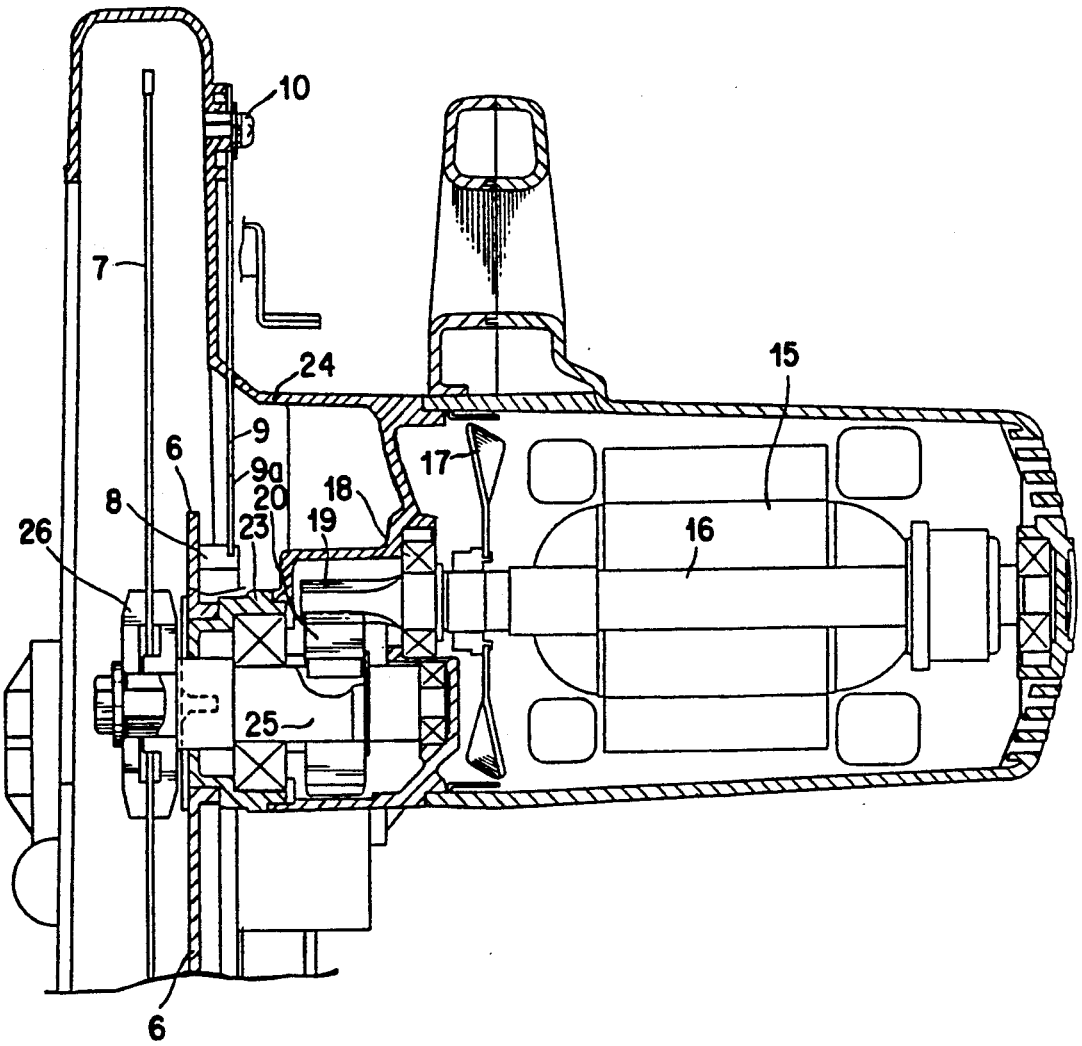
FIG. 3 is a partially cross-sectional view showing the cutter shown in FIGS. 1 and 2.

FIG. 3 is a cross-sectional view showing the desk-top type cutter according to the present invention. A rotary shaft 16 of a drive motor 15 is rotatably supported by a bearing 18 provided in a housing 24. A gear 19 is provided at the end portion of the rotary shaft 16 and is engaged with a gear 20 provided on the rotary shaft 25. A circular saw blade 7 is fixedly mounted at the end of the rotary shaft 25 through a flange 26. Thus, the circular saw blade 7 is rotated by the rotation of the rotary shaft 25.

A gear case cover 23 fixed to the housing 24 at one end is provided between the gear 20 and the flange 26. The safety cover 6 is rotatably mounted at the other stepped portion of the gear case cover 23. The gear 8 is integrally formed with the safety cover 6.

The lever 9 pivotably mounted on the pin 10 is engaged with the gear 8. Reference numeral 17 denotes a cooling fan for the drive motor 15.

The operation of the desk-top cutter provided with the safety cover 6 will be described.

First of all, the body 3 is swung in the direction B (in FIG. 1) about the support shaft 4. The lumber (not shown) is laid on the table 1. Subsequently, when the operator grips the handle H, the pressure portion 9*b* of the level 9 is pressed in the direction C (in FIG. 1) by the operator's thumb so that the end provided with the engagement portion 9*a* of the level 9 is moved against the biasing force of the spring 11 in the direction C'. As a result, the engagement portion 9*a* of the lever 9 is meshed with the teeth 8*a* of the gear 8. When the lever 9 is further moved, the gear 8 is rotated in the arrowed direction D. During this rotation, since the gear 8 is integrally secured with the safety cover 6, the safety cover 6 is also rotated in the direction E. Under this exposed condition, a cutting line of the lumber to be cut is aligned with the circular saw blade 7 by the operator. Under this positional alignment, the lumber is securely fixed by a fastening member (not shown). Thereafter, the level 9 is released and is moved in the direction F by the biasing force of the spring 11, so that the safety cover 6 is moved to a position where the safety cover 6 covers the circular saw blade 7. During the cutting operation, the body 3 is moved in the direction G, and at the same time, the rotational drive motor (not shown) for the circular saw blade 7 is driven to thereby cut the lumber at the desired position. The safety cover 6 abuts against the lumber as it is cut, thereby opening the safety cover and allowing the circular saw blade further access to the lumber while shielding the operator from the revolving saw blade 7.

Figure 4:
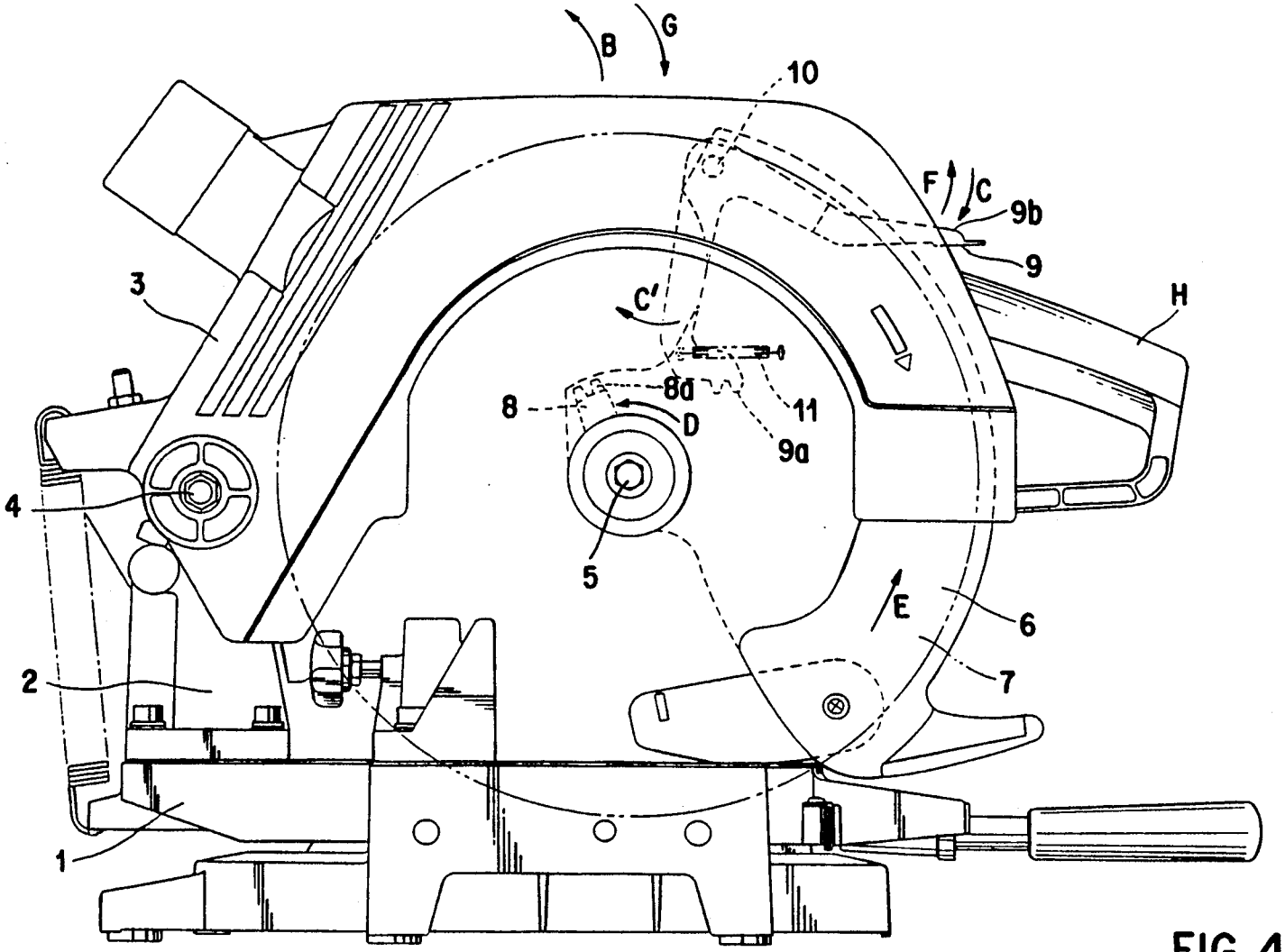
FIG. 4 is a front view showing a desk-top type cutter in accordance with another embodiment of the invention.
Figure 5:
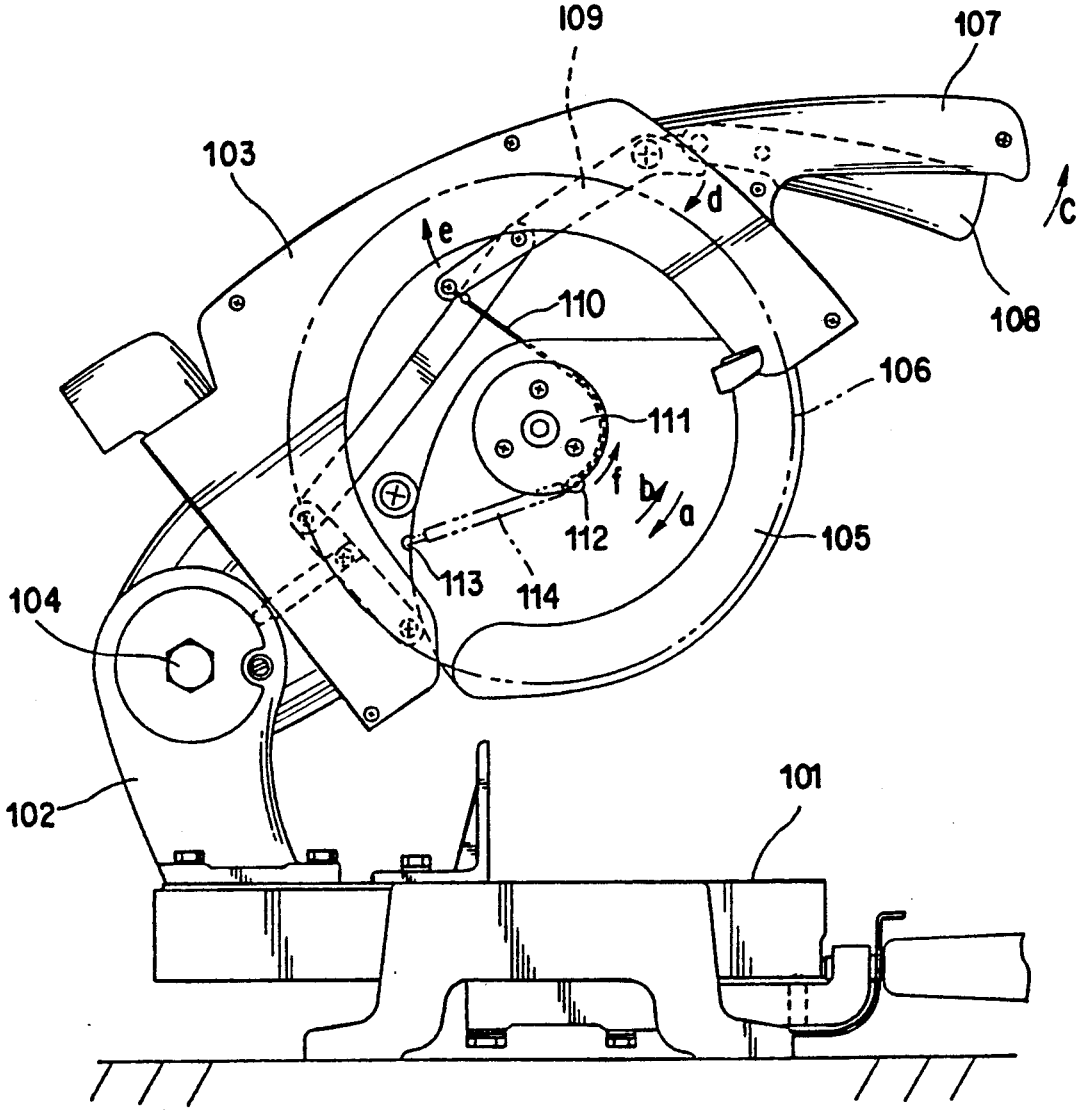
FIG. 5 PRIOR ART
FIG. 5 is a front view showing a conventional desk-top type cutter.

FIG. 4 is a front view showing a desk-top type cutter in accordance with another embodiment of the invention, in which like reference numerals are added to members or elements corresponding to those shown in FIG. 1 to eliminate the duplicated explanation thereof. In this embodiment, the gear 8 is provided with two teeth on the outer periphery 8*a* thereof, and engagement portion 9*a* of the lever 9 is formed with two engagement teeth. As a result, in the case where the cutting operation is conducted with the level 9, i.e. pressure end portion 9*b* being depressed downwardly, it is possible to easily release the engagement between the lever 9 and the gear 8 by moving the lever 9 in the opposite direction at the swing limit position of the lever 9.

Although in the first and second embodiments of the invention, the gear 8 is provided with a plurality of teeth and the engagement portion 9*a* of the lever 9 is also provided with a plurality of engagement teeth, it is not always necessary to provide the plurality of teeth therefor and the single tooth may be used.

As described above, according to the invention, the gear mechanism is used as an opening/closing mechanism of the safety cover, whereby it is possible to ensure the force transmission and it is easy to assemble the mechanism. Also, since the spring member is used only to bias the lever, it is possible to use a weak spring therefor. Thus, it is possiible to reduce the number of the mechanical parts and the manufacture cost.

What is claimed is:

1. A desk-top cutter fixed to a table comprising:

a circular saw pivotally supported by a support member attached to the table;

a circular saw blade mounted on a shaft of the circular saw;

a safety cover pivotally supported about the shaft of the circular saw so as to shield an operator from the circular saw blade, wherein the safety cover abuts against a top surface of a workpiece, and rotates in a direction away from the top surfacce of the workpiece to provide access for the saw blade to engage the workpiece;

a safety cover operating mechanism for opening and closing the safety cover comprising:

a gear member having at least one tooth fixedly connected to an outer surface of the safety cover and rotatable therewith, an L-shaped leverl member mounted to said circular saw at a central portion of said lever member to pivot about an axis offset from the shaft, said lever member comprising at least one engaging member provided on a first end of said lever member for releasably engaging said gear member and a pressing portion provided on a second end of said lever member, said pressing portion extending outwardly from the circular saw and being releasably engageable by the hand of an operator of said circular saw, and a biasing means for biasing said lever member from a pressed position to a released position, said biasing means having a first end attached to said first end of said lever member and a second end attached to said circular saw, wherein when said second end of said lever member is moved to a pressed position, the engaging member engages the gear member to move the safety cover to an open position to expose said blade and when said second end of said lever member is moved to said released position, said gear member and said safety cover are moved from said open position to at least a partially closed position by said engaging member.

2. A desk-top type cutter according to claim 1, wherein said gear member is provided with a plurality of teeth arranged on an outer periphery of the gear member, the teeth having equal pitch.

3. A desk-top type cutter according to claim 2, wherein the number of teeth of the gear member is two.

4. A desk-top type cutter according to claim 1, wherein said lever member is provided with a plurality of engaging members each in a shape of a gear tooth.

5. A desk-top type cutter according to claim 4, wherein the number of the engaging members is two.

6. A desk-top cutter according to claim 1, wherein said means for biasing the lever member comprises a spring to bias the lever member in a direction separating the engaging member of the lever from the gear member.

7. A desk-top type cutter according to claim 1, wherein said gear member is concentrically mounted about the shaft of the circular saw.

* * * * *